US011982475B2

(12) United States Patent
Sishtla

(10) Patent No.: US 11,982,475 B2
(45) Date of Patent: May 14, 2024

(54) REFRIGERANT LUBRICATION SYSTEM WITH SIDE CHANNEL PUMP

(71) Applicant: Carrier Corporation, Palm Beach Gardens, FL (US)

(72) Inventor: Vishnu M. Sishtla, Manlius, NY (US)

(73) Assignee: Carrier Corporation, Palm Beach Gardens, FL (US)

( * ) Notice: Subject to any disclaimer, the term of this patent is extended or adjusted under 35 U.S.C. 154(b) by 482 days.

(21) Appl. No.: 16/845,773

(22) Filed: Apr. 10, 2020

(65) Prior Publication Data

US 2020/0355193 A1 Nov. 12, 2020

Related U.S. Application Data

(60) Provisional application No. 62/844,533, filed on May 7, 2019.

(51) Int. Cl.

| | |
|---|---|
| ***F25B 31/00*** | (2006.01) |
| ***F25B 1/10*** | (2006.01) |
| ***F25B 31/02*** | (2006.01) |

(52) U.S. Cl.

CPC ..... *F25B 31/004* (2013.01); *F25B 1/10* (2013.01); *F25B 31/02* (2013.01); *F25B 2500/16* (2013.01)

(58) Field of Classification Search

CPC ..... F25B 31/004

See application file for complete search history.

(56) References Cited

U.S. PATENT DOCUMENTS

| | | | | |
|---|---|---|---|---|
| 2,042,394 | A * | 5/1936 | Gay | F25B 31/004 62/84 |
| 2,223,882 | A * | 12/1940 | Beline | F25B 31/004 137/340 |
| 2,246,845 | A * | 6/1941 | Durden | F25B 31/004 62/207 |
| 3,276,215 | A | 10/1966 | McDonell | |
| 5,469,713 | A | 11/1995 | Wardle et al. | |
| 5,606,872 | A | 3/1997 | Teraski | |
| 5,761,914 | A * | 6/1998 | Carey | F25B 31/004 62/84 |
| 5,881,564 | A * | 3/1999 | Kishimoto | F04D 29/063 62/193 |
| 6,170,286 | B1 | 1/2001 | Kauper | |
| 6,182,467 | B1 | 2/2001 | Zhong et al. | |

(Continued)

FOREIGN PATENT DOCUMENTS

| | | |
|---|---|---|
| DE | 1812511 | 11/1968 |
| WO | 204876 A1 | 1/2002 |

(Continued)

OTHER PUBLICATIONS

Extended European Search Report for EP Application No. 20173290.6 dated Sep. 21, 2020.

*Primary Examiner* — Christopher R Zerphey

(74) *Attorney, Agent, or Firm* — Carlson, Gaskey & Olds, P.C.

(57) ABSTRACT

A vapor compression system includes a compressor that has a suction port and a discharge port. A heat rejection heat exchanger is coupled to the discharge port to receive compressed refrigerant. A heat absorption heat exchanger is coupled to the suction port. A lubricant flowpath goes from the heat absorption heat exchanger to the compressor. A side channel pump is located in the lubricant flowpath.

17 Claims, 2 Drawing Sheets

(56) References Cited

U.S. PATENT DOCUMENTS

| | | | | |
|---|---|---|---|---|
| 6,216,474 | B1 | 4/2001 | Sishtla | |
| 6,233,967 | B1 * | 5/2001 | Seewald | F04C 29/026 62/84 |
| 6,357,239 | B2 | 3/2002 | Carey | |
| 6,516,627 | B2 * | 2/2003 | Ring | F25B 31/004 62/193 |
| 6,672,102 | B1 | 1/2004 | Huenniger et al. | |
| 9,671,146 | B2 | 6/2017 | Jandal et al. | |
| 9,851,130 | B2 | 12/2017 | Love et al. | |
| 2008/0271477 | A1 | 11/2008 | Holmes | |
| 2016/0153688 | A1 | 6/2016 | Ronk et al. | |
| 2018/0180333 | A1 | 6/2018 | Sishtla et al. | |

FOREIGN PATENT DOCUMENTS

| | | |
|---|---|---|
| WO | 2013032611 | 7/2014 |
| WO | 2018038926 | 3/2018 |
| WO | 2018052694 | 3/2018 |

* cited by examiner

REFRIGERANT LUBRICATION SYSTEM WITH SIDE CHANNEL PUMP

CROSS-REFERENCE TO RELATED APPLICATION

This application claims priority to U.S. Provisional Application No. 62/844,533, which was filed on May 7, 2019 and is incorporated herein by reference.

BACKGROUND

The disclosure relates to compressor lubrication. More particularly, the disclosure relates to centrifugal compressor lubrication.

A typical centrifugal chiller operates with levels of lubricant at key locations in flowing refrigerant. The presence of an oil reservoir, typically with more than a kilogram of oil will cause an overall content of oil to exceed 1.0 percent by weight when the oil accumulation in the reservoir is added to the numerator and denominator of the fraction. The concentration will be relatively low in the condenser (e.g., 50 ppm to 500 ppm). At other locations, the concentrations will be higher. For example the oil sump may have 60+ percent oil. This oil-rich portion is used to lubricate bearings. Thus, flow to the bearings will typically be well over 50 percent oil. At one or more locations in the system, strainers, stills, or other means may be used to withdraw oil and return it to a reservoir. It is desirable to remove the oil from locations where it may interfere with heat transfer or other operations.

SUMMARY

In one exemplary embodiment, a vapor compression system includes a compressor that has a suction port and a discharge port. A heat rejection heat exchanger is coupled to the discharge port to receive compressed refrigerant. A heat absorption heat exchanger is coupled to the suction port. A lubricant flowpath extends from the heat absorption heat exchanger to the compressor. A side channel pump is located in the lubricant flowpath.

In a further embodiment of the above, the side channel pump includes an inlet coupled to an outlet on the heat absorption heat exchanger.

In a further embodiment of any of the above, the outlet on the heat absorption heat exchanger is located in a bottom portion of the heat absorption heat exchanger.

In a further embodiment of any of the above, the side channel pump includes a vapor outlet port and a liquid outlet port.

In a further embodiment of any of the above, the liquid outlet port is coupled to bearings in the compressor.

In a further embodiment of any of the above, the compressor includes at least one bearing drain port coupled to an inlet to the heat absorption heat exchanger.

In a further embodiment of any of the above, a controller is in communication with the side channel pump and is configured to activate the side channel in response to an operating condition of the compressor to direct fluid flow through the lubricant flowpath.

In a further embodiment of any of the above, the vapor outlet port is coupled to the heat rejection heat exchanger.

In a further embodiment of any of the above, the vapor outlet port is coupled to the compressor.

In a further embodiment of any of the above, the compressor includes a first stage and a second stage. The vapor outlet port is coupled to a second stage of the compressor upstream of the first stage in the compressor.

In a further embodiment of any of the above, the heat absorption heat exchanger is a falling film evaporator that has a separator/distributor.

In a further embodiment of any of the above, an inlet to the heat absorption heat exchanger is located above the separator/distributor.

In a further embodiment of any of the above, the heat absorption heat exchanger is a flooded evaporator that has a separator/distributor.

In a further embodiment of any of the above, an inlet to the heat absorption heat exchanger is located below the separator/distributor.

In another exemplary embodiment, a method of operating a vapor compression system includes the steps of receiving a signal to initiate operation of a compressor to move fluid through a main flowpath of the vapor compression system that has a heat rejection heat exchanger and a heat absorption heat exchanger. A side channel pump is operated to draw fluid from the heat absorption heat exchanger and separate the fluid between a vapor outlet port and a liquid outlet port. A liquid is directed from the liquid outlet port to a bearing system in the compressor prior to operating the compressor.

In a further embodiment of any of the above, a vapor is directed from the vapor outlet port to a second stage of the compressor upstream of a first stage in the compressor.

In a further embodiment of any of the above, a vapor is directed from the vapor outlet port to the heat rejection heat exchanger.

In a further embodiment of any of the above, a portion of the liquid is directed from the liquid outlet port on the side channel pump to the heat absorption heat exchanger.

In a further embodiment of any of the above, the portion of the liquid from the liquid outlet port directed to the heat absorption heat exchanger is directed to a location above a separate/distributor in the heat absorption heat exchanger.

In a further embodiment of any of the above, the step of directing the liquid to the bearing system is controlled by a controller.

DETAILED DESCRIPTION

Figure 1:
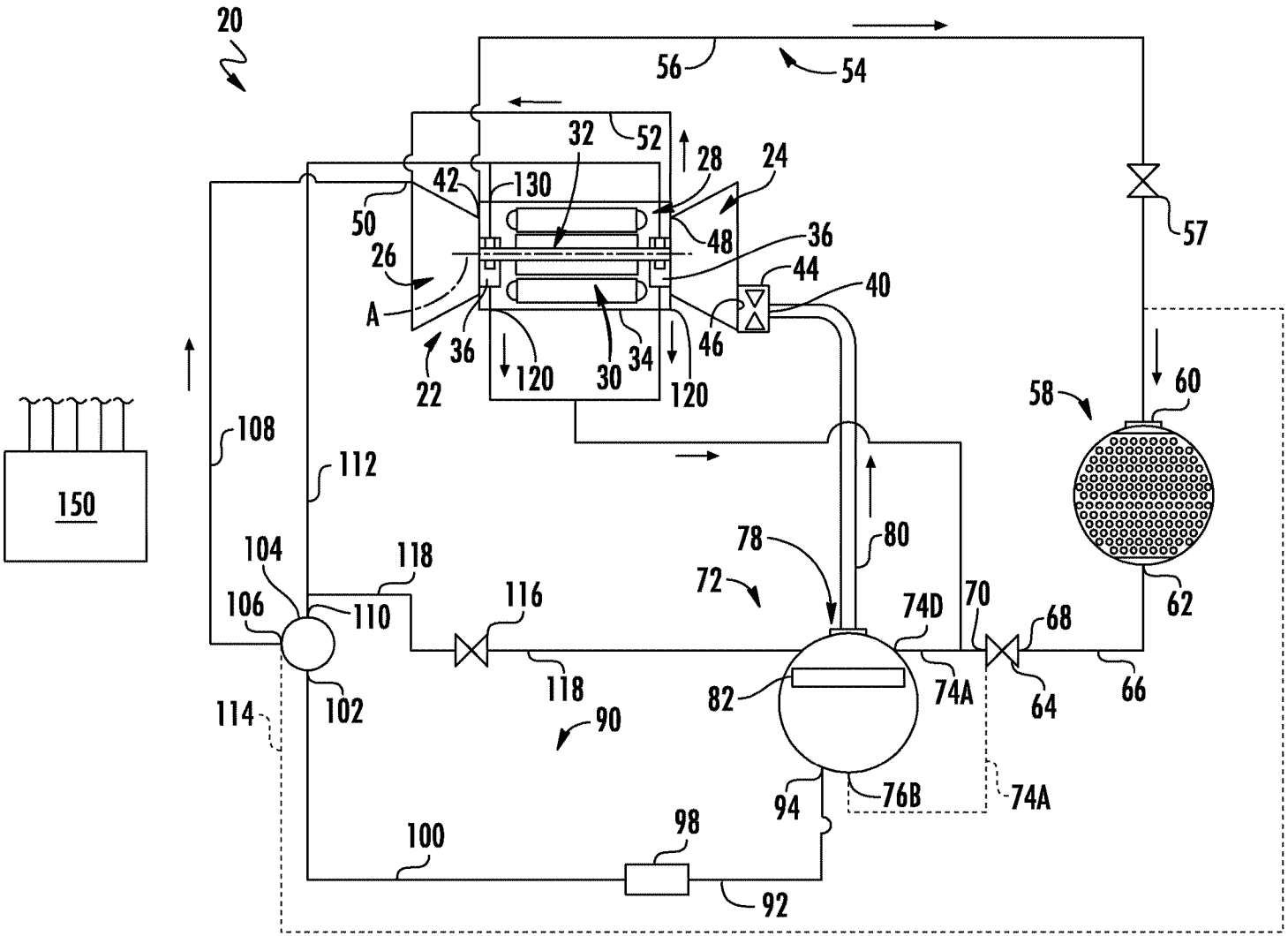
FIG. 1 is a schematic view of a vapor compression system.

FIG. 1 shows a vapor compression system 20. This reflects details of one particular baseline system. FIG. 1 shows flow arrows (and thus associated valve conditions) associated with operating conditions that may correspond to a startup condition or, generally, a condition where there is a low pressure difference between a condenser 58 and an evaporator 72.

The exemplary system 20 is a chiller having a compressor 22 driving a recirculating flow of refrigerant. The exemplary compressor 22 is a two-stage centrifugal compressor having a first stage 24 and a second stage 26. Impellers of the first and second stages 24, 26 are co-spooled and directly driven by an electric motor 28 having a stator 30 and a rotor 32. The compressor 22 has a housing or case 34 supporting one or more bearings 36 to in turn support the rotor 32 for rotation about its central longitudinal axis A forming a central longitudinal axis of the compressor 22.

The bearings 36 are rolling element bearings with one or more circumferential arrays of rolling elements radially sandwiched between an inner race on the rotor (e.g., mounted to a shaft) and an outer race on the housing (e.g., press fit into a bearing compartment). Exemplary rolling elements include balls, straight rollers (e.g., including needles), and tapered rollers. Exemplary bearings are hybrid bearings with steel races and ceramic rolling elements. Exemplary ceramic rolling elements are silicon nitride ceramic balls. Exemplary races are 52100 bearing steel rings and high nitrogen CrMo martensitic steel rings, including Bölher N360 (trademark of BÖHLER Edelstahl GmbH & Co KG, Kapfenberg, Austria) and Cronidur 30 (trademark of Energietechnik Essen GmbH, Essen, Germany).

The exemplary vapor compression system 20 is an essentially oil or lubricant-free system. Accordingly, it omits various components of traditional oil systems such as dedicated oil pumps, oil separators, oil reservoirs, and the like. However, a very small amount of oil or other material that may typically be used as a lubricant may be included in the overall refrigerant charge to provide benefits that go well beyond the essentially non-existent amount of lubrication such material would be expected to provide. As is discussed further below, a small amount of material may react with bearing surfaces to form protective coatings. Accordingly, even though traditional oil-related components may be omitted, additional components may be present to provide refrigerant containing the small amounts of material to the bearings. In discussing this below, terms such as "oil-rich" may be used. Such terms are understood as used to designate conditions relative to other conditions within the present system. Thus, "oil-rich" as applied to a location in the FIG. 1 system may be regarded as extremely oil-depleted or oil-free in a traditional system.

The exemplary compressor 22 has an overall inlet (inlet port or suction port) 40 and an overall outlet (outlet port or discharge port) 42. In the exemplary configuration, the outlet 42 is an outlet of the second stage 26. The inlet 40 is upstream of an inlet guide vane array 44 which is in turn upstream of the first stage inlet 46. The first stage outlet 48 is coupled to the second stage inlet 50 by an interstage line (interstage) 52. Although inlet guide vanes (IGVs) are shown only for the first stage 24, alternative implementations may additionally or alternatively have IGVs for the second stage 26. Another variation is a single stage compressor with inlet guide vanes.

As is discussed further below, additional flows of refrigerant may exit and/or enter the compressor 22 at additional locations. From the discharge port 42, a main refrigerant flowpath 54 proceeds downstream in a normal operational mode along a discharge line 56 to a first heat exchanger, such as the condenser 58. An isolation valve 57 is located in the line 56 for isolating the compressor 22 from the condenser 58. In the normal operational mode, the condenser 58 is a heat rejection heat exchanger. The exemplary condenser 58 is a refrigerant-water heat exchanger wherein refrigerant passes over tubes of a tube bundle which carry a flow of water (or other liquid). The condenser 58 has one or more inlets and one or more outlets. An exemplary primary inlet is labeled 60. An exemplary primary outlet is labeled 62.

An expansion device 64 is located fluidly downstream of the outlet 62 from the condenser 58. A condenser outlet line 66 connects the outlet 62 with an inlet 68 to the expansion device 64 along the main refrigerant flowpath 54. An outlet 70 of the expansion device 64 is fluidly coupled to a second heat exchanger, such as the evaporator 72, through either a line 74A connected to an inlet 76A on the evaporator 72 and/or a line 74B to an inlet 76B on the evaporator 72.

In the exemplary chiller implementation, the evaporator 72 or "cooler" is a refrigerant-water heat exchanger which may have a vessel and tube bundle construction wherein the tube bundle carries the water or other liquid being cooled in the normal operational mode. For simplicity of illustration, FIG. 1 omits details including the inlet and outlet for the flows of water or other heat transfer fluid for the heat exchangers. The evaporator 72 has a main outlet 78 connected to a suction line 80 which completes the main refrigerant flowpath 54 returning to the inlet 40 at the compressor 22.

Additionally, the evaporator 72 could be a falling film evaporator or a flooded evaporator both having a separator/distributor 82 located in an upper portion of the evaporator 72. When the evaporator 72 is a falling film evaporator, the line 74A will direct the fluid from the expansion device 64 to the inlet 76A above the separator/distributor 82. When the evaporator 72 is a flooded evaporator, the line 74B will direct fluid from the expansion device 64 to the inlet 76B below the separator/distributor 82.

In addition to the main refrigerant flowpath 54, the vapor compression system 20 includes a bearing lubrication flowpath 90. The bearing lubrication flowpath 90 include a line 92 extending from an outlet 94 on a bottom portion of the evaporator 72 to a filter/dryer 98. From the filter/dryer 98, a line 100 connects the filter/dryer 98 to an inlet 102 side-channel pump 104. The bearing lubrication flowpath 90 is able to remove saturated liquid from the evaporator 72 that would normally result in pump cavitation in the compressor 22 by the use of the side-channel pump 104. Removal of the saturated liquid from the evaporator 72 can be beneficial because it contains "oil-rich" fluid that can be used to lubricate the bearings 36 in the compressor 22.

In illustrated example, the side channel pump 104 includes a vapor outlet 106 that directs vapor to the second stage inlet 50 through line 108 to be compressed by the second stage 26 of the compressor 22. Alternatively or in addition to, the vapor from the vapor outlet 106 in the side channel pump 104 can be directed back to the condenser 58 through line 114. The side channel pump 104 also includes a liquid outlet 110 that directs "oil-rich" fluid to the bearings 36 through line 112. The compressor 22 includes at least one liquid drain port 120 that collects the liquid sent to the bearings 36 through line 112 and directs the liquid back to the evaporator 72. If the evaporator 72 is a falling film evaporator as discussed above, the at least one drain port 120 is coupled with the line 74A and if the evaporator 72 is a flooded evaporator as discussed above, the at least one drain port 120 is coupled with the line 74B.

The discharge pressure of the side channel pump 104 in line 112 is maintained by a pressure relief valve 116 in line 118. Line 118 connects line 112 from the liquid outlet 108 on the side channel pump 104 to a top portion of the evaporator 72 above the separator/distributor 82. By injecting the liquid from the liquid outlet 110 on the side channel pump 104 to this location in the evaporator 72, liquid from the side channel pump 104 will provide additional cooling capacity to the evaporator 72.

Figure 2:
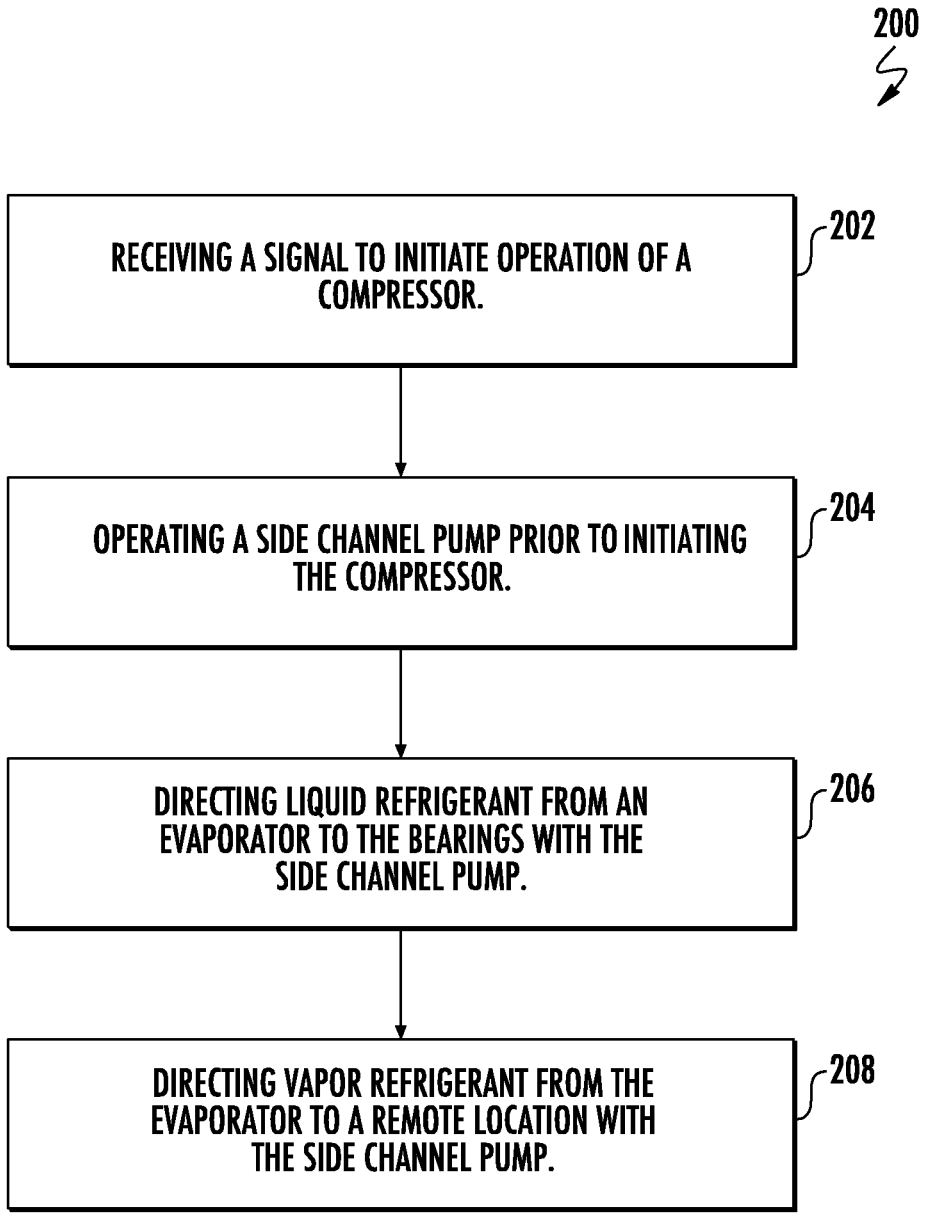
FIG. 2 is an operational flow chart for the vapor compression system of FIG. 1.

FIG. 2 illustrates a method 200 of operating the vapor compression system 20. Prior to operating the vapor compression system 20, the controller 150 receives a signal to initiate operation of the compressor 22 to move the refrigeration medium through the main refrigerant flowpath 54 including both the condenser 58 and the evaporator 72. (Step 202). Prior to operating the compressor 22, the controller 150 operates the side channel pump 104 for a predetermined length of time to pre-lubricate the bearings 36 in the compressor 22. (Step 204).

The fluid drawn by the side channel pump 104 from the evaporator 72 is a saturated fluid with a mixture of liquid and vapor. Unlike most pumps, the side channel pump 104 is able to pump a saturated fluid to either the vapor outlet 106 for a vapor portion of the fluid or the liquid outlet 110 for a liquid portion of the fluid.

Because the liquid portion pumped by the side channel pump 104 is "oil-rich" due to the location it is drawn from in the evaporator 72, the liquid exiting the liquid outlet 110 and traveling through line 112 is directed to the bearings 36. (Step 206). The liquid directed to the bearing 36 can then be collected and injected back into the main refrigerant flowpath 54 upstream of the evaporator 72 and downstream of the expansion device 64. The vapor portion exiting the side channel pump 104 through the vapor outlet 106 can then travel to a remote location, such as the compressor 22 through line 108 or the condenser 58 through line 114. (Step 208).

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A vapor compression system comprising:
a compressor having a suction port and a discharge port;
a heat rejection heat exchanger coupled to the discharge port to receive compressed refrigerant;
a heat absorption heat exchanger coupled to the suction port;
a lubricant flowpath from the heat absorption heat exchanger to the compressor; and
a side channel pump located in the lubricant flowpath;
wherein the side channel pump includes an inlet coupled to an outlet on the heat absorption heat exchanger;
wherein the side channel pump includes a vapor outlet port and a liquid outlet port with the vapor outlet port coupled to the heat rejection heat exchanger downstream of the compressor and upstream of the heat rejection heat exchanger.

2. The system of claim 1, wherein the outlet on the heat absorption heat exchanger is located in a bottom portion of the heat absorption heat exchanger.

3. The system of claim 1, wherein the liquid outlet port is coupled to bearings in the compressor.

4. The system of claim 3, wherein the liquid outlet port is coupled through a fluid line to a top portion of the heat absorption heat exchanger above a separator/distributor and the fluid line includes a pressure relief valve.

5. The system of claim 3, wherein the compressor includes at least one bearing drain port coupled to an inlet of the heat absorption heat exchanger.

6. The system of claim 3, including a controller in communication with the side channel pump and configured to activate the side channel pump in response to an operating condition of the compressor to direct fluid flow through the lubricant flowpath.

7. The system of claim 1, wherein the vapor outlet port is coupled to the compressor.

8. The system of claim 7, wherein the compressor includes a first stage and a second stage and the vapor outlet port is coupled to a second stage of the compressor upstream of the first stage in the compressor.

9. The system of claim 8, wherein the first stage and the second stage are co-spooled.

10. The system of claim 1, wherein the heat absorption heat exchanger is a falling film evaporator having a separator/distributor.

11. The system of claim 10, wherein an inlet to the heat absorption heat exchanger is located above the separator/distributor.

12. The system of claim 1, wherein the heat absorption heat exchanger is a flooded evaporator having a separator/distributor.

13. The system of claim 12, wherein an inlet to the heat absorption heat exchanger is located below the separator/distributor.

14. The system of claim 1, wherein the compressor is a two-stage centrifugal compressor.

15. The system of claim 1, wherein an expansion device is located fluidly downstream of an outlet from the heat rejection heat exchanger.

16. The system of claim 1, wherein the heat absorption heat exchanger is a refrigerant-water heat exchanger.

17. The system of claim 1, wherein the liquid outlet port is coupled to bearings in the compressor, the compressor includes at least one bearing drain port coupled to an inlet of the heat absorption heat exchanger, and the heat absorption heat exchanger includes one of a falling film evaporator having a separator/distributor or a flooded evaporator having a separator/distributor.

* * * * *